US006318829B1

(12) United States Patent
Suzuki

(10) Patent No.: US 6,318,829 B1
(45) Date of Patent: Nov. 20, 2001

(54) INK JET RECORDING APPARATUS AND INK EJECTION CONTROL METHOD

(75) Inventor: Shogo Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/102,035

(22) Filed: Jun. 22, 1998

(30) Foreign Application Priority Data

Jul. 28, 1997 (JP) ..... 9-201116

(51) Int. Cl.[7] ..... B41J 29/38; B41J 2/045
(52) U.S. Cl. ..... 347/11; 347/9; 347/68
(58) Field of Search ..... 347/9, 10, 11, 347/15

(56) References Cited

U.S. PATENT DOCUMENTS 5,576,743 * 11/1996 Momose et al. ..... 347/11
6,130,681 * 10/2000 Ando ..... 347/15

FOREIGN PATENT DOCUMENTS 0 841 164 A1 * 5/1998 (EP) ..... B41J/2/045
A-4-73154 3/1992 (JP) ..... B41J/2/045

* cited by examiner

*Primary Examiner*—John Barlow
*Assistant Examiner*—Alfred E Dudding
(74) *Attorney, Agent, or Firm*—Oliff & Berridge, PLC

(57) ABSTRACT

Disclosed are an ink jet recording apparatus and method to achieve good balance between the amount of ink supplied and the amount of ink ejected. An ink jet head of the recording apparatus has an ink reservoir chamber having a predetermined capacity for receiving ink from an ink source. The ink reservoir chamber has a nozzle for ejecting ink, and a piezoelectric element. The piezoelectric element is deformable by changing a drive voltage applied thereto, so as to change the capacity of the chamber. A control unit controls the drive voltage applied to the piezoelectric element from the drive voltage generator so that the capacity of the ink reservoir chamber is increased to a first value in a supplying stage, and then reduced to a second value in an ejecting stage, in each ink ejection cycle. Furthermore, the control unit changes the displacement of the piezoelectric element by changing the waveform of the drive voltage. Therefore, in a relatively later part of the ejection stage, the chamber capacity is maintained at a third value between the first and second values, and then reduced to the second value, thus allowing the supplying of ink for the next cycle to be quickly and reliably performed.

15 Claims, 7 Drawing Sheets

INK JET RECORDING APPARATUS AND INK EJECTION CONTROL METHOD

BACKGROUND OF THE INVENTION

1. Field of Invention

The invention relates to an ink jet recording apparatus and an ink ejection control method in the ink jet recording apparatus and, more particularly, to an improvement for achieving good balance between the amount of ink supplied to an ink reservoir chamber of an inkjet head and the amount of ink ejected from a nozzle provided in the ink reservoir chamber.

2. Description of Related Art

An ink jet recording apparatus is a recording apparatus that has a relatively simple structure and readily performs high-speed and high-quality printing. The ink jet recording apparatus has a carriage that is provided for reciprocal movements in directions orthogonal to the paper conveying direction, and an ink jet head that is supported by the carriage. FIG. 5 is an exploded perspective view of main portions of a typical ink jet head.

Components shown in FIG. 5 constitute an actuator part of an ink jet head 1. The actuator part has a base 2, a piezoelectric element member 3, a diaphragm 4, a cavity plate 5 and a nozzle plate 6. The nozzle plate 6 has many (e.g., 128) nozzles 7 that are arranged in two rows. In FIG. 5, the individual nozzles 7 are not shown, but a two-row arrangement of the nozzles 7 is indicated by two solid lines.

The cavity plate 5 has a pair of "L"-shaped ink channels 8 and ink reservoir chambers 9 branching orthogonally from the ink channels 8. The number of ink reservoir chambers 9 is equal to the number of nozzles 7. Each ink reservoir chamber 9 communicates with its corresponding nozzle 7. In FIG. 5, the number of ink reservoir chambers 9 shown is less than the actual number provided.

The piezoelectric element member 3 has many (e.g., 128) piezoelectric elements 10 so as to individually increase and reduce the capacity of the ink reservoir chambers 9. In FIG. 5, the number of piezoelectric elements 10 shown is less than the actual number provided.

The diaphragm 4 separates the piezoelectric element member 3 and the cavity plate 5 from each other. The diaphragm 4 has a suitable elasticity.

The base 2 supports the piezoelectric element member 3, the diaphragm 4, the cavity plate 5 and the nozzle plate 6. Two ink supply channels 11 and two return ink channels 12 extend through the base 2, the piezoelectric element member 3 and the diaphragm 4, for ink circulation between the ink channels 8 and the corresponding ink source (not shown).

The ink reservoir chambers 9 will be described in detail with reference to FIG. 6, wherein one of the ink reservoir chambers 9 is shown in an enlarged sectional view. An ink reservoir chamber 9 formed in the cavity plate 5 communicates with an ink channel 8 (see FIG. 5) through a communication channel 13. An orifice 14 is formed in a lower portion of the ink reservoir chamber 9 that is opposite from the communication channel 13. The orifice 14 communicates with its corresponding nozzle 7.

A piezoelectric element 10 is disposed in contact with the diaphragm 4, which provides a portion of the walls that define the ink reservoir chamber 9. The piezoelectric element 10 is deformed by changing the drive voltage applied thereto. For example, upon application of a predetermined drive voltage, the piezoelectric element 10 expands in a direction indicated by an arrow 15, thereby reducing the capacity of the reservoir chamber 9 as indicated by a broken line 16. When the application of the drive voltage is discontinued, the piezoelectric element 10 reduces to the original state as indicated by solid lines, thereby restoring (that is, increasing) the capacity of the ink reservoir chamber 9.

Ink is supplied from an ink source (not shown) to the two ink channels 8 through the two ink supply channels 11 (see FIG. 5). When the capacity of the ink reservoir chamber 9 is increased by deforming the piezoelectric element 10 from the expanded state to the reduced state upon the discontinuation in the application of the drive voltage, ink is drawn into the reservoir chamber 9 from the ink channel 8 through the communication channel 13, thereby filling the reservoir chamber 9.

When the drive voltage is applied to the piezoelectric element 10 in order to expand the piezoelectric element 10, and therefore reduce the capacity of the reservoir chamber 9, ink is ejected out of the nozzle 7 through the orifice 14.

Therefore, a desired image can be recorded on a recording sheet by controlling the drive voltage applied to selected piezoelectric elements 10 so as to eject ink from the corresponding nozzles 7 while moving or scanning the ink jet head 1 in the directions orthogonal to the recording sheet conveying direction. During the recording operation, selected ink reservoir chambers 9 in the ink jet head 1 repeatedly undergo an ink ejection cycle that includes a supplying stage and an ejecting stage as described above.

It is important that the amount of ink supplied into an ink reservoir chamber 9 in the supplying stage in an ink ejection cycle and the amount of ink ejected from the ink reservoir chamber 9 in the ejecting stage in the same cycle, be well balanced. A sway of the balance will result in, for example, a failure in ink ejection from the nozzle 7. Normally, the proportion of the amount of ink supplied to the amount of ink ejected, which is determined by a capacity change in the ink reservoir chamber 9 caused by deformation of the piezoelectric element 10 in the ejection cycle, is most preferably 1. However, even through the proportion is less than 1, no substantial problem arises as long as the proportion is about 1 in average over the entire operation, including occasions when printing is not performed, (e.g., at the time of a carriage return). If the ejection/supply ratio decreases to, for example, about 0.5, an ink ejection failure will occur.

The incidence of ink ejection failure may remarkably increase if a design change is made, for example, a reduction of the diameter of the nozzles 7, or an increase in the length of the nozzles 7, and the like. This failure is considered to be a result or manifestation of an insufficient amount of ink supplied relative to the amount of ink ejected, that is, an insufficient refill. Various causes of insufficient refills may be considered, such as an increase in the ink passage resistance, a reduction in capillarity of ink in the nozzles 7, a reduction in the reflection coefficient of the nozzles 7 whereby pressure waves in the ink are attenuated rapidly, and the like.

However, it is rather difficult to design the many various ink passages within the ink jet head 1 so as to maintain a good balance between the amount of ink supplied into the ink reservoir chambers 9 and the amount of ink ejected therefrom, as described above.

SUMMARY OF THE INVENTION

Accordingly, it is an object of the invention to provide an ink jet recording apparatus and an ink ejection control method which allow the setting of a good balance between the amount of ink supplied to the ink reservoir chambers and the amount of ink ejected therefrom, without relying on a design of ink passages in the ink jet head.

According to one aspect of the invention, there is provided an ink jet recording apparatus including: an inkjet head including an ink reservoir chamber having a predetermined capacity for receiving ink from an ink source and having a nozzle for ejecting ink, and a piezoelectric element associated with the ink reservoir chamber and being deformable by changing a drive voltage thereto, so as to change the capacity of the ink reservoir chamber; a drive voltage generator unit that generates the drive voltage to be applied to the piezoelectric element; and a drive voltage control unit that controls the drive voltage applied to the piezoelectric element from the drive voltage generator unit, so as to achieve an ink ejection cycle that includes a supplying stage in which ink is supplied into the ink reservoir chamber from the ink source by increasing the capacity of the ink reservoir chamber to a first value, and an ejecting stage in which ink is ejected from the ink reservoir chamber through the nozzle by reducing the capacity of the ink reservoir chamber to a second value. The drive voltage control unit controls the drive voltage applied to the piezoelectric element from the drive voltage generator unit so that, in a relatively later part of the ejecting stage of each ink ejection cycle, the capacity of the ink reservoir chamber is maintained at a third value between the first value and the second value, and then reduced to the second value.

It has been found that the supply of ink into the ink reservoir chamber can be sufficiently performed by reducing the capacity of the ink reservoir chamber to the second value after maintaining the capacity at the third value between the first and second values, during the course of capacity reduction of the ink reservoir chamber to the second value in the relatively later part of each ink ejection cycle.

In the ink jet recording apparatus of the invention, the drive voltage control unit may control the drive voltage applied to the piezoelectric element from the drive voltage generator unit so that, in the relatively later part of the ejecting stage, after the capacity of the ink reservoir chamber is maintained at the third value during the course of capacity reduction of the ink reservoir chamber to the second value, the capacity of the ink reservoir chamber is reduced to the second value.

The drive voltage control unit may also control the drive voltage applied to the piezoelectric element from the drive voltage generator unit so that, in the later part of the ejecting stage, after the capacity of the ink reservoir chamber is reduced to the second value, the capacity of the ink reservoir chamber is increased to the third value (so that ink will not be ejected from the nozzle in a period that follows), and then reduced again to the second value.

According to another aspect of the invention, there is provided an ink ejection control method in an ink jet recording apparatus including an ink jet head that has an ink reservoir chamber that has a predetermined capacity for receiving ink from an ink source and a nozzle for ejecting ink, and which further has a piezoelectric element associated with the ink reservoir chamber, that is deformed by changing a drive voltage thereto, so as to change the capacity of the ink reservoir chamber.

The ink jet recording apparatus further includes a drive voltage generator unit that generates the drive voltage to be applied to the piezoelectric element. In the ink ejection control method, the drive voltage applied to the piezoelectric element from the drive voltage generator unit is controlled so as to achieve an ink ejection cycle that includes a supplying stage in which ink is supplied into the ink reservoir chamber from the ink source by increasing the capacity of the ink reservoir chamber to a first value, and an ejecting stage in which ink is ejected from the ink reservoir chamber through the nozzle by reducing the capacity of the ink reservoir chamber to a second value. The drive voltage applied to the piezoelectric element from the drive voltage generator unit is also controlled so that, in a relatively later part of the ejecting stage of each ink ejection cycle, the capacity of the ink reservoir chamber is maintained at a third value between the first value and the second value, and then reduced to the second value.

In the ink ejection control method, it is also possible to achieve a capacity changing pattern in which, in a relatively later part of the ejecting stage of each ink ejection cycle, the capacity of the ink reservoir chamber is maintained at the third value between the first value and the second value, and then reduced to the second value, as described below.

The drive voltage applied to the piezoelectric element from the drive voltage generator unit may be controlled so that, in the relatively later part of the ejecting stage, after the capacity of the ink reservoir chamber is maintained at the third value during the course of capacity reduction of the ink reservoir chamber to the second value, the capacity of the ink reservoir chamber is reduced to the second value.

The drive voltage applied to the piezoelectric element from the drive voltage generator unit may also be controlled so that, in the later part of the ejecting stage, after the capacity of the ink reservoir chamber is reduced to the second value, the capacity of the ink reservoir chamber is increased to the third value so that ink will not be ejected from the nozzle in a period that follows, and then reduced again to the second value.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Preferred embodiments of the present invention will be described in detail hereinafter with reference to the accompanying drawings.

Figure 1:
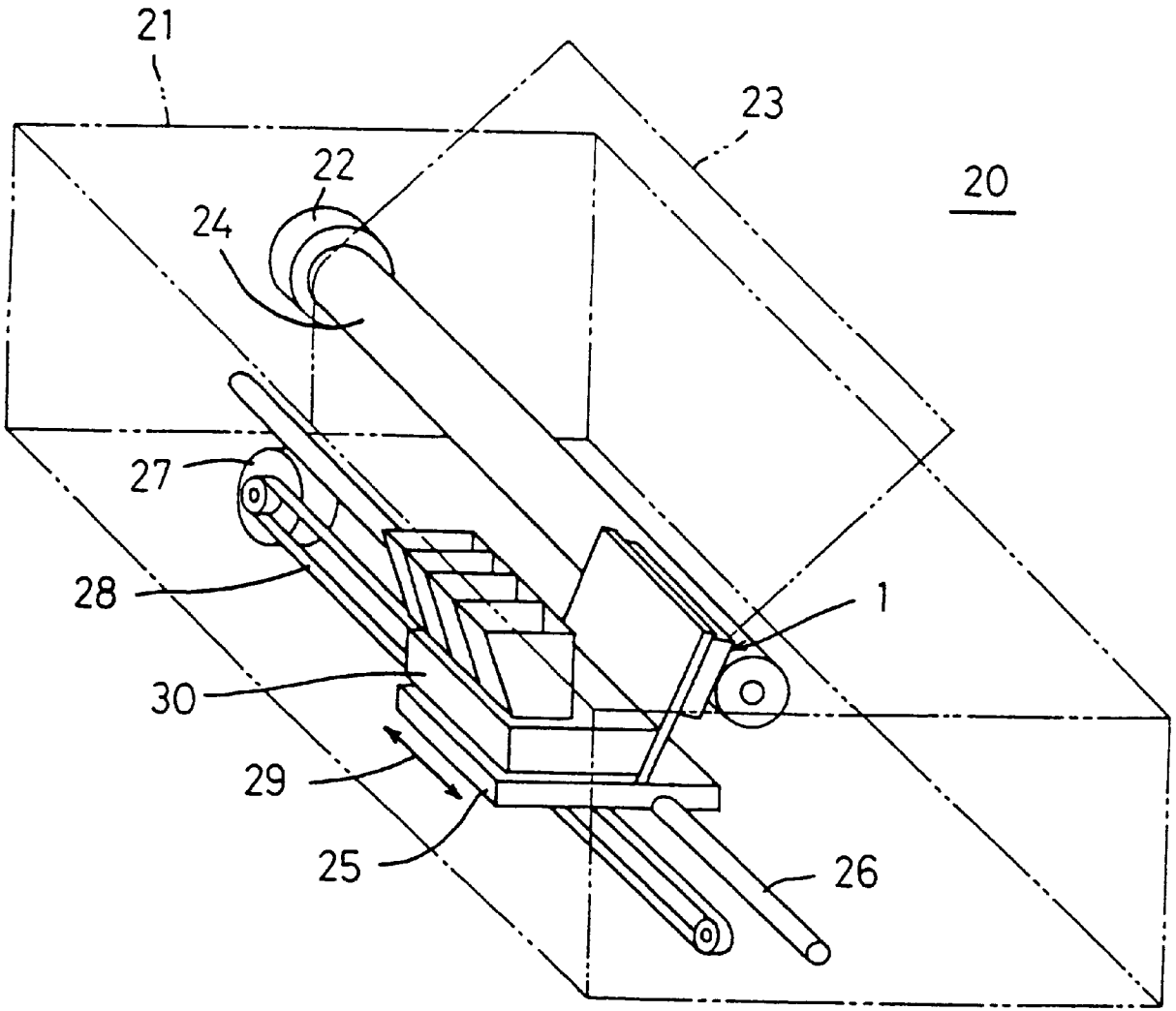
FIG. 1 is a perspective view of an ink jet recording apparatus according to a preferred embodiment of the invention.

FIG. 1 is a perspective view of an ink jet recording apparatus according to a preferred embodiment of the invention. An ink jet recording apparatus 20 has a housing 21 indicated by the broken lines in FIG. 1. Disposed within the housing 21 are a conveying roller 24 that is driven by a conveying motor 22 to convey a recording sheet 23, and an ink jet head 1 facing the recording sheet 23. The ink jet head 1 is substantially the same as that shown in FIG. 5.

The ink jet head 1 is supported by a carriage 25. The carriage 25 is supported for reciprocal linear movements, by a guide rod 26 that is disposed in a fixed manner relative to the housing 21. The carriage 25 is fixed to a specific site on a belt 28 that is driven back and forth by a carriage motor 27. Therefore, the carriage 25, carrying the ink jet head 1 thereon, is driven by the carriage motor 27 to reciprocate in directions orthogonal to the conveyance direction of the recording sheet 23. The ink jet head 1 is thus scanned over the recording sheet 23 as indicated by arrows 29.

Figure 5:
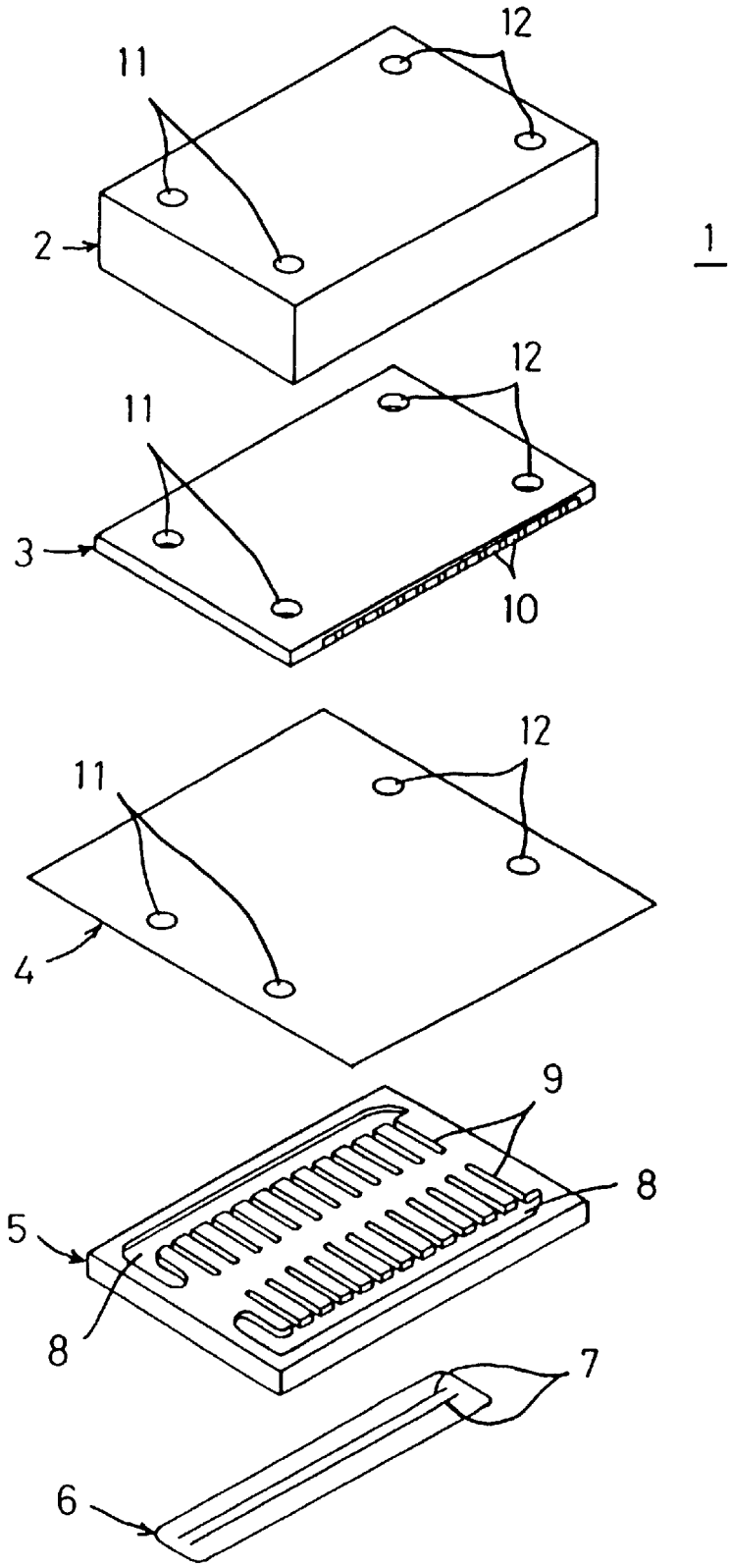
FIG. 5 is an exploded perspective view of an ink jet head of an ink jet recording apparatus.

As shown in FIG. 5, the ink jet head 1 has an arrangement for each of four color inks (yellow, magenta, cyan and black (for example). An ink tank 30 acts as an ink source, designed to supply the color inks separately to the ink jet head 1. The structure of the ink jet head 1 is substantially the same as described with reference to FIGS. 5 and 6, so there is no need to repeat the description.

Figure 2:
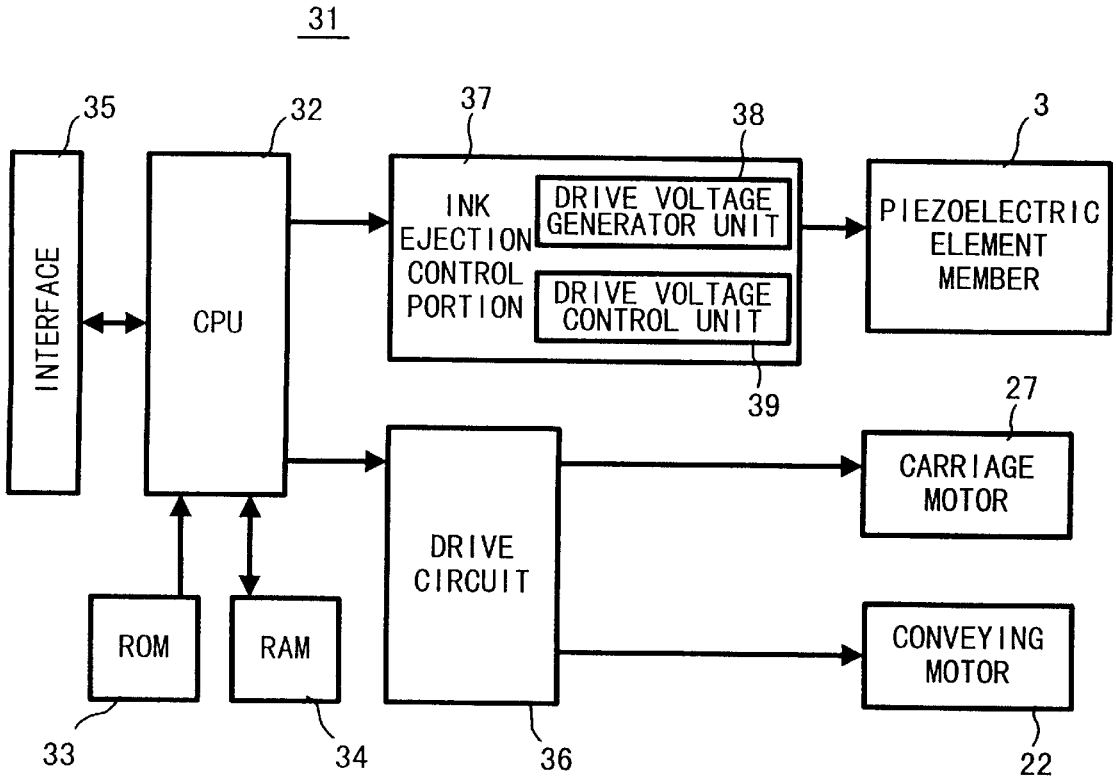
FIG. 2 is a block diagram of a control unit of the ink jet recording apparatus.

FIG. 2 is a block diagram of a control device 31 of the ink jet recording apparatus 20. The control device 31 has a CPU 32 that performs various operations, a ROM 33 and a RAM 34 for storing programs, parameters, and the like, necessary for the control of the inkjet recording apparatus 20, an interface 35 for the exchanging of data necessary for printing between the ink jet recording apparatus 20 and a personal computer, (not shown) or the like, a drive circuit 36 for driving the carriage motor 27 and the conveying motor 22 on the basis of control signals from the CPU 32, and an ink ejection control portion 37 for controlling and performing the ink ejection from the ink reservoir chambers 9 through the nozzles 7.

The ink ejection control portion 37 has a drive voltage generator unit 38 for generating a drive voltage to be applied to the individual piezoelectric elements 10 (FIG. 6) of the piezoelectric element member 3, and a drive voltage control unit 39 for controlling the drive voltage applied to the individual piezoelectric elements 10 from the drive voltage generator unit 38.

Figure 3:
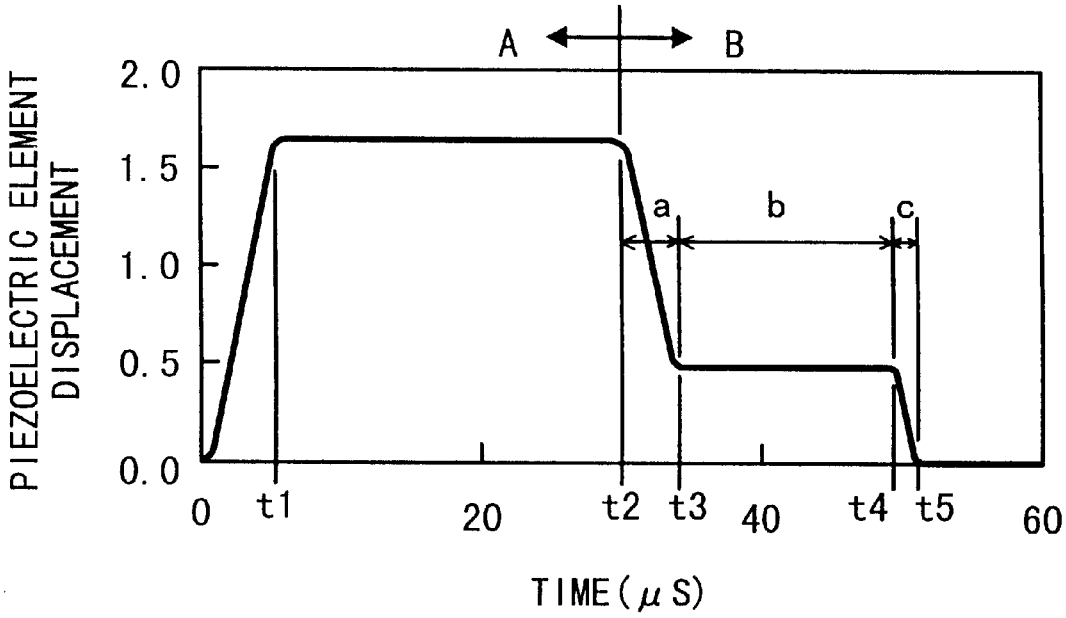
FIG. 3 is a graph indicating changes of displacement of a piezoelectric element over time corresponding to the waveform of the drive voltage controlled by the drive voltage control unit, shown in FIG. 2.
Figure 6:
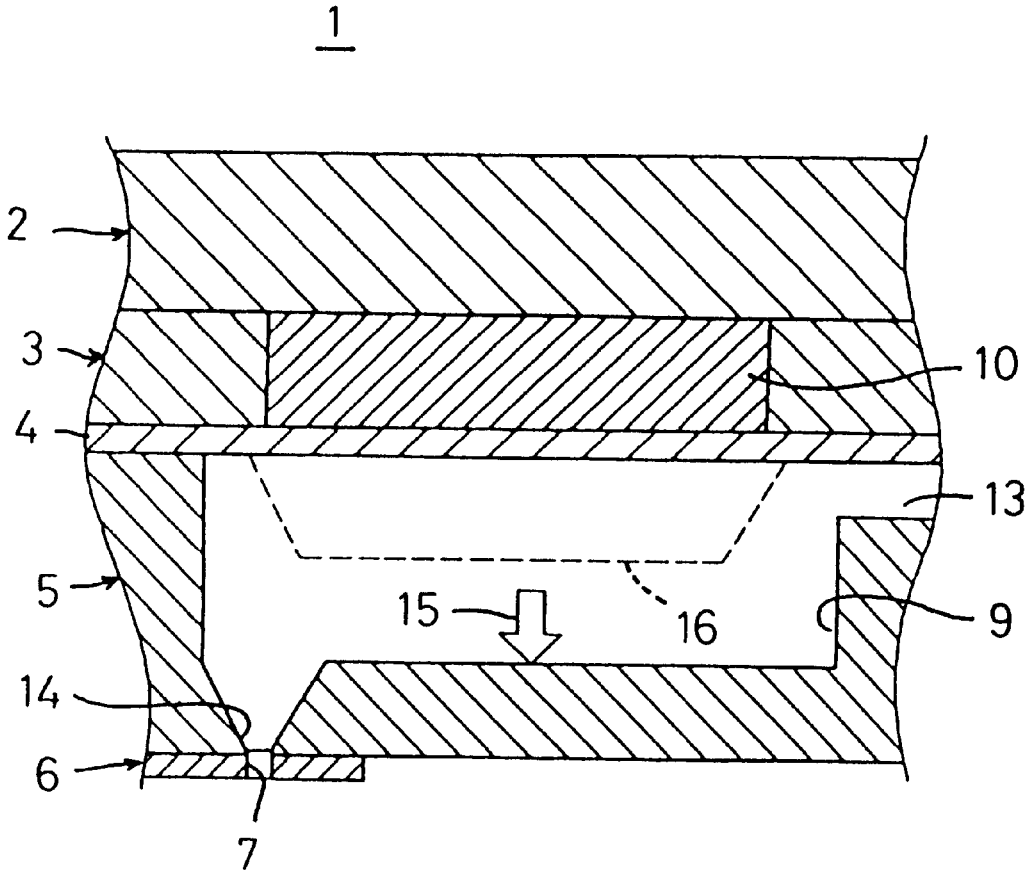
FIG. 6 is an enlarged sectional view of one of the ink reservoir chambers formed in the ink jet head shown in FIG. 5.

In this embodiment, the drive voltage control unit 39 controls the drive voltage applied to the individual piezoelectric elements 10 so that the piezoelectric elements 10 deform over time by amounts of displacement as indicated in FIG. 3. Normally, the amount of displacement of a piezoelectric element, indicated along the ordinate axis in the graph of FIG. 3, is approximately proportional in absolute value to the drive voltage applied thereto. In addition, the changes in the capacity of the ink reservoir chamber 9 correspond to the amounts of displacement of the piezoelectric element. In the graph of FIG. 3, the amount of displacement of a piezoelectric element 10 indicated by the broken line 16 in FIG. 6, is represented as "0.0", and displacements of the piezoelectric element 10 toward the state indicated by the solid lines, are represented as positive displacements. Therefore, as the displacement of the piezoelectric element 10 increases in FIG. 3, the capacity of the ink reservoir chamber 9 increases.

Each piezoelectric element 10 is deformed progressively so as to produce amounts of displacement as indicated in FIG. 3, by the drive voltage control unit 39 controlling the drive voltage applied to the piezoelectric element 10 from the drive voltage generator unit 38.

More specifically, through the control by the drive voltage control unit 39, the piezoelectric element 10 reaches an amount of the displacement of 1.7 at a time t1, and maintains this amount of displacement until a time t2, thereby bringing about a supplying stage A where the capacity of the ink reservoir chamber 9 is increased to a first value (corresponding to the displacement of 1.7) so that ink is supplied from the ink tank 30 into the ink reservoir chamber 9.

Subsequently, the piezoelectric element 10 reduces its displacement, thereby bringing about an ejecting stage B wherein the capacity of the ink reservoir chamber 9 is reduced to a second value (corresponding to a displacement of 0.0) so that ink is ejected from the ink reservoir chamber 9 through the nozzle 7. In this manner, an ink ejection cycle, including the supplying stage A and the ejecting stage B, is performed. In this embodiment, a particular control function is performed in a relatively later part of the ejecting stage B in each ink ejection cycle.

In performing the particular control function according to this embodiment, the piezoelectric element 10 starts to reduce its displacement at the time t2 and stops reducing the displacement 0.5 at a time t3. The displacement of the piezoelectric element 10 is maintained at 0.5 from the time t3 until a time t4, and then starts decreasing again and reaches 0.0 at a time t5. Along with this pattern of displacement change, the capacity of the ink reservoir chamber 9 is maintained at a third value (corresponding to the displacement of 0.5) during an intermediate period before the capacity thereof is reduced to the second value (corresponding to the displacement of 0.0), that is, during a relatively later part of the ejecting stage B. The capacity reduction of the ink reservoir chamber 9 in the ejecting stage B causes ink ejection from the nozzle 7. It is considered that in reality, ink ejection occurs during a short period up to the time t5.

It has been found that through this control, the supplying of ink, or the like, is quickly and reliably performed in the supplying stage A in each ink ejection cycle and, as a result, good balance between the amount of ink supplied in the supplying stage A and the amount of ink ejected in the ejecting stage B is achieved.

Although the mechanism of this favorable effect is not altogether clear, one speculation is as follows. The temporary pause in the capacity reduction of each ink reservoir chamber 9 starting at the time t3 in the ejecting stage B, effectively mitigates disturbance in the fluid (ink) caused by the rapid capacity reduction, so that the supplying of ink in the supplying stage A for the next ink ejection cycle can be quickly and reliably performed. Furthermore, it is also speculated that even if the ink supplied in the supplying stage A is not sufficient, a supplemental amount of ink can be supplied during the period between the times t3 and t4 in the ejecting stage B.

To confirm the effect of the above-described control, ink ejection speeds, amounts of ink ejected, amounts of ink supplied, and ratios of amount of ink supplied/amount of ink ejected (supply/ejection ratios) were measured and determined with respect to the drive waveform conditions 1, 2 and 3, as shown in Table 1. Experiments with respect to the drive waveform conditions 1–3 shown in Table 1 were performed using the same ink jet head 1. In the drive waveform conditions 1 and 2, the control function according to the invention was performed, wherein the amount of displacement of the piezoelectric elements 10 in the supplying stage A was set to 1.7 and, with regard to the waveform of the drive voltage applied to the piezoelectric elements 10, the time periods a (=t3−t2), b (=t4−t3) and c (=t5−t4) were set as shown in Table 1. The drive waveform condition No. 3 is a comparative example wherein the amount of displacement of the piezoelectric elements 10 in the supplying stage A was set to 1.5 and the displacement of the piezoelectric elements 10 was simply reduced in the ejecting stage B, not following the stepwise changing pattern as indicated in FIG. 3.

TABLE 1

| Waveform condition | Time period (μs) | | | Eject speed | Ink ejected | Ink supply | Supply/ |
|---|---|---|---|---|---|---|---|
| No. | a | b | c | (m/s) | (pL) | (pL) | eject |
| 1 | 4 | 15 | 1 | 7.4 | 77 | 57 | 0.74 |
| 2 | 3.5 | 15 | 1.5 | 6.2 | 72 | 44 | 0.61 |
| 3 | — | — | — | 6.7 | 77 | 39 | 0.51 |

As shown in Table 1, in the drive waveform condition No. 3, the ratio of amount of ink supplied/amount of ink ejected was as low as 0.51, whereas in the drive waveform conditions Nos. 1 and 2, the supply/ejection ratio was increased to 0.74 and 0.61, respectively. Particularly, the supply/ejection ratio obtained in the drive waveform condition No. 1 was as high as 0.74. As can be seen from these examples, it is possible to increase the supply/ejection ratio by appropriately adjusting the time periods a, b and c.

Figure 7A:
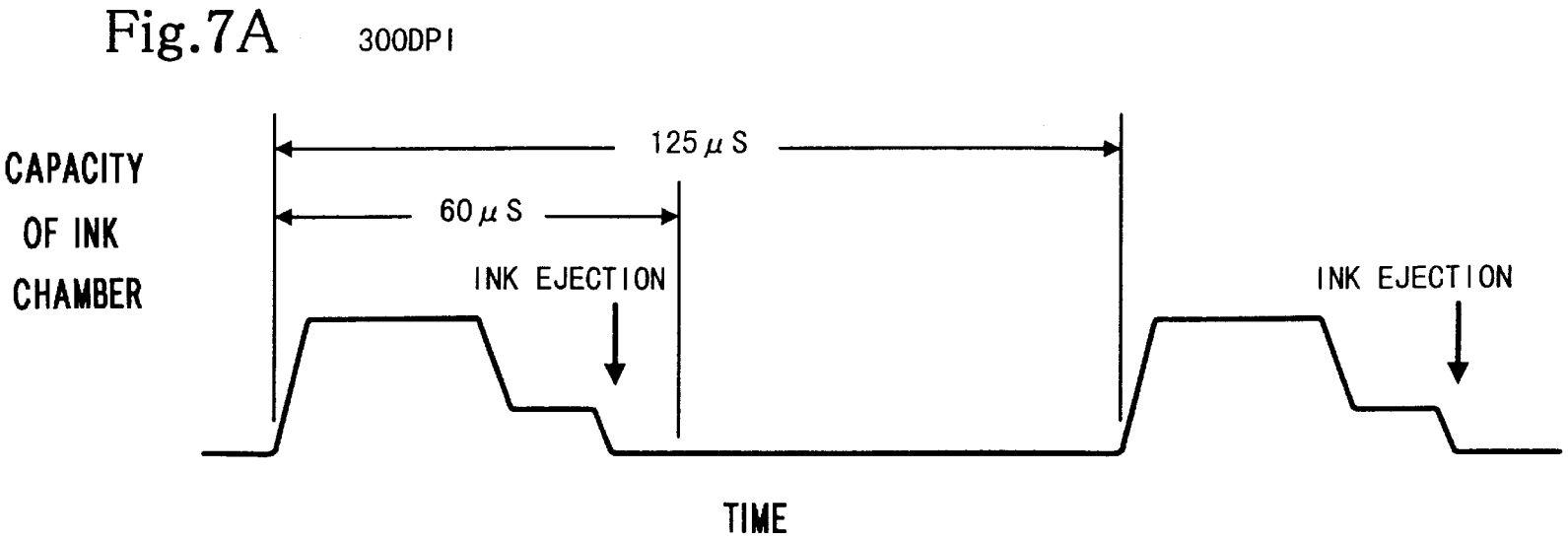
FIGS. 7A and 7B are charts indicating changes of displacement of a piezoelectric element over time when the ink ejection cycle, according to the embodiment indicated in FIG. 3, is continually repeated.
Figure 7B:
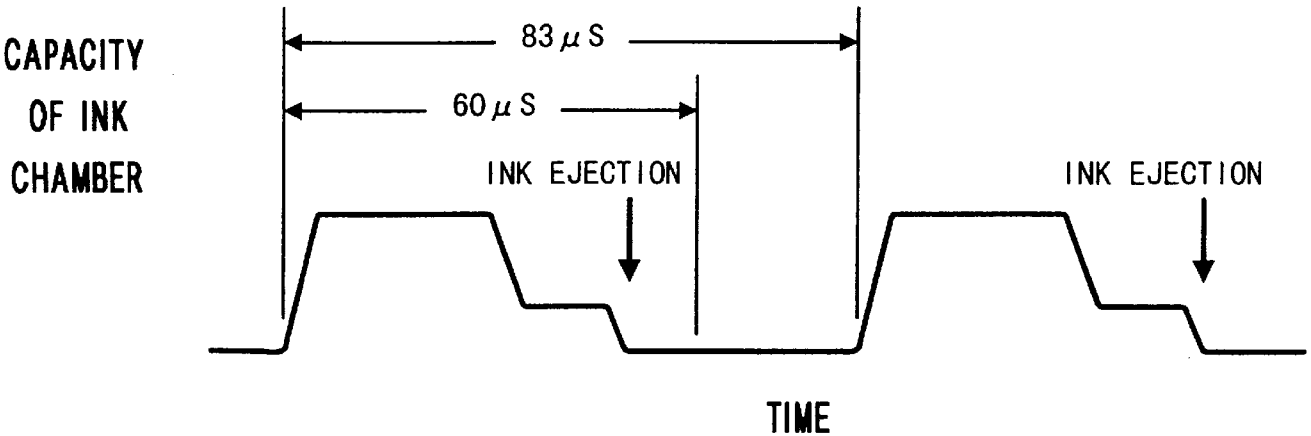
Figure 8A:
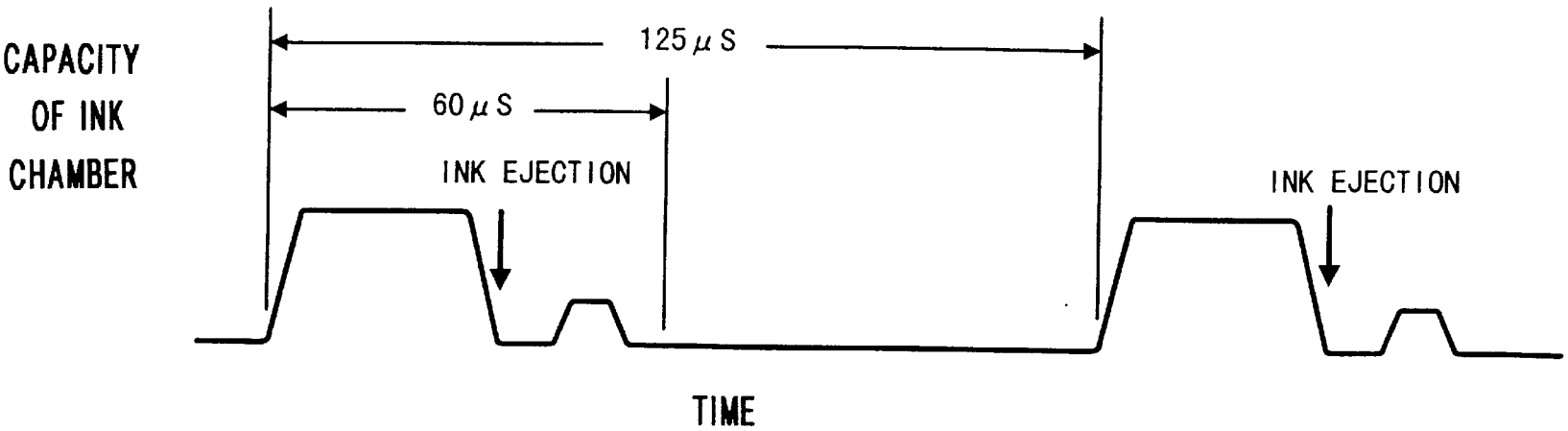
FIGS. 8A and 8B are charts indicating changes of displacement of a piezoelectric element over time when the ink ejection cycle, according to the embodiment indicated in FIG. 4, is continually repeated.
Figure 8B:
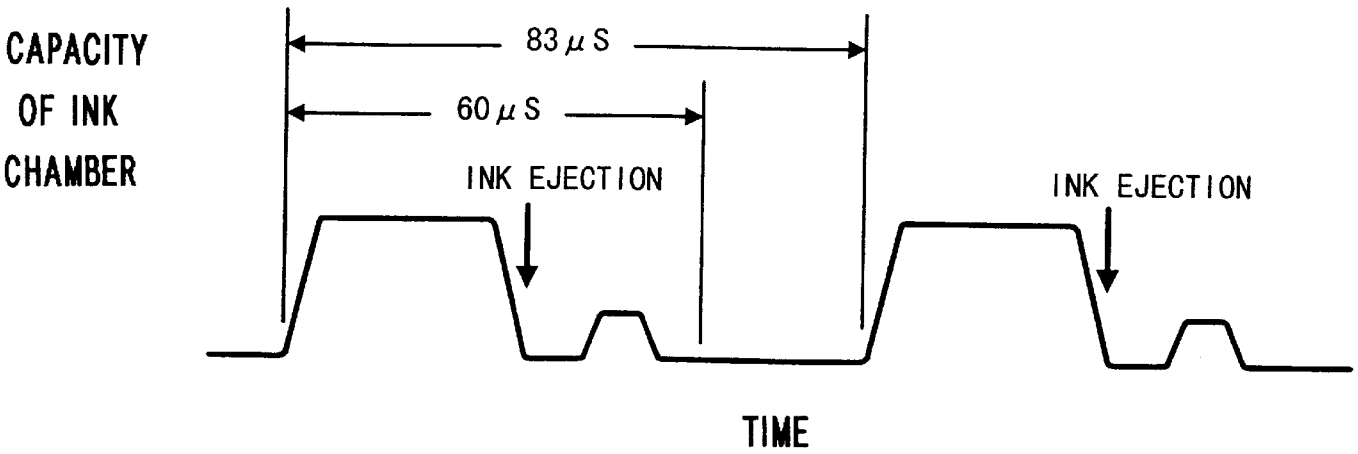

Therefore, this embodiment eliminates the situation of an insufficient refill during printing and ensures precise ink ejection at predetermined dot intervals, even if there is a need to continually eject ink from the same nozzle of the ink jet head 1 as the carriage 25 moves, for example, if there is a need to repeatedly eject ink at intervals of 125 μs for 300 dpi, or 83 μs for 600 dpi, as indicated in FIGS. 7A and 7B.

In the control function according to the embodiment, the capacity of each ink reservoir chamber 9 is maintained at the third value (corresponding to the displacement of 0.5) between the first value (corresponding to the displacement of 1.7) and the second value (corresponding to the displacement of 0.0) in a relatively later part of the ejecting stage B in each ink ejection cycle, and then reduced to the second value (corresponding to the displacement of 0.0). In the control function indicated in FIG. 3, in a relatively later part of the ejecting stage B, after the capacity of the ink reservoir chamber 9 is maintained at the third value (corresponding to the displacement of 0.5) during the course of capacity reduction to the second value (corresponding to the displacement of 0.0), the capacity of the ink reservoir chamber 9 is reduced to the second value (corresponding to the displacement of 0.0).

Figure 4:
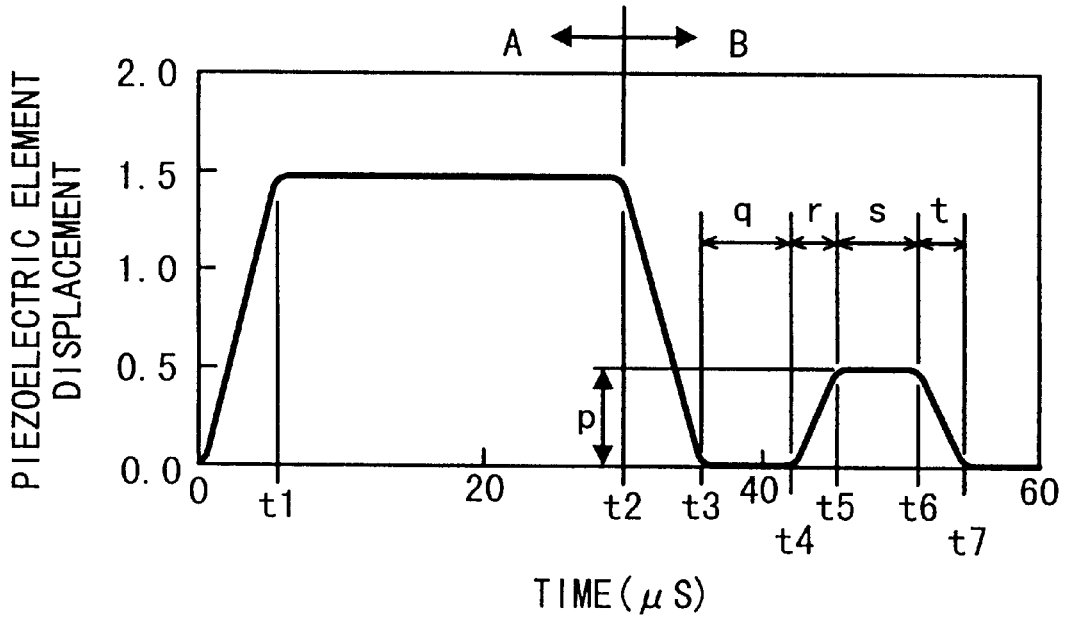
FIG. 4 is a graph indicating a displacement changing pattern of a piezoelectric element according to another embodiment of the invention, in substantially the same graph arrangement.

In another possible mode of the control function, which achieves substantially the same advantages as described above, the ink reservoir chamber capacity may be changed as indicated in FIG. 4. FIG. 4 is a graph indicating another embodiment of the invention in substantially the same graph arrangement as in FIG. 3. Through the control function according to this embodiment, a piezoelectric element 10 reaches an amount of displacement of 1.5 at a time t1, and maintains that amount of displacement until a time t2. Along with this displacement changing pattern, the capacity of the ink reservoir chamber 9 is increased to a first value (corresponding to the displacement of 1.5), thereby bringing about a supplying stage A wherein ink is supplied from the ink tank 30 into the ink reservoir chamber 9. The supplying stage A is substantially the same as that indicated in FIG. 3.

Subsequently, the piezoelectric element 10 reduces its displacement, thereby bringing about an ejecting stage B wherein the capacity of the ink reservoir chamber 9 is reduced to a second value (corresponding to a displacement of 0.0) so that ink is ejected from the ink reservoir chamber 9 through the nozzle 7, as in the foregoing embodiment. In this manner, an ink ejection cycle, including the supplying stage A and the ejecting stage B, is performed. In the embodiment as indicated in FIG. 4, a control function as described below, is performed in a relatively later part of the ejecting stage B in each ink ejection cycle.

In performing the control function, the piezoelectric element 10 starts to reduce its displacement at the time t2 and reaches the displacement of 0.0 at a time t3, and then starts to increase the displacement again at a time t4 and reaches a displacement of 0.5 at a time t5. After the displacement of 0.5 is maintained until a time t6, the displacement starts to decrease again and reaches 0.0 at a time t7. Along with the displacement changing pattern in a relatively later part of the ejecting stage B, the capacity of the ink reservoir chamber 9 is reduced to the second value (corresponding to the displacement of 0.0), and then increased to a third value (corresponding to the displacement of 0.5) so that ink will not be ejected from the nozzle 7 in a period that follows. After the capacity of the third value is maintained for a predetermined period, the capacity is reduced again to the second value (corresponding to the displacement of 0.0). The capacity reduction of the ink reservoir chamber 9 in the ejecting stage B causes ink ejection from the nozzle 7. It is considered that in reality, ink ejection occurs during a very short period up to the time t3.

It has been found that through the control function according to this embodiment, the supplying of ink and the like, is quickly and reliably performed in the supplying stage A of the ink ejection cycle and, as a result, good balance between the amount of ink supplied in the supplying stage A and the amount of ink ejected in the ejecting stage B is achieved.

The mechanism of this favorable effect may be speculated as follows. Disturbance in the fluid (ink) caused by the rapid capacity reduction of an ink reservoir chamber 9 during the period between the times t2 and t3 in the ejecting stage B is effectively mitigated by the subsequent capacity changes during the period between the times t4 and t7. Furthermore, ink is actively drawn into the ink reservoir chamber 9 during the period between the times t4 and t5, as well. Therefore, the supply of ink in the supplying stage A in the next ink ejection cycle can be quickly and reliably performed.

To confirm the effect of the control function according to this embodiment, ink ejection speeds, amounts of ink ejected, amounts of ink supplied, and ratios of amount of ink supplied/amount of ink ejected (supply/ejection ratios) were measured and determined with respect to drive waveform conditions Nos. 4–12, as shown in Table 2. Experiments with respect to the drive waveform conditions Nos. 4–12 shown in Table 2 were performed using the same ink jet head 1. In the drive waveform conditions Nos. 4–11, the control function according to this embodiment was performed, wherein the amount of displacement of the piezoelectric elements 10 in the supplying stage A was set to 1.5. In addition, the amount p of displacement of the piezoelectric elements 10 in the ejecting stage B, and with regard to the waveform of the drive voltage applied to the piezoelectric elements 10, the time periods q (=t4−t3), r (=t5−t4), s (=t6−t5) and t (=t7−t6), were set as shown in Table 2. The waveform condition No. 12 is a comparative example substantially the same as the drive waveform condition No. 3, shown in Table 1.

TABLE 2

| Waveform condition No. | Displacement p | Time period (μs) q | r | s | t | Eject speed (m/s) | Ink ejected (pL) | Ink supply (pL) | Supply/eject |
|---|---|---|---|---|---|---|---|---|---|
| 4 | 0.30 | 5 | 3 | 6 | 3 | 6.5 | 75 | 45 | 0.59 |
| 5 | 0.50 | 5 | 3 | 6 | 3 | 6.2 | 77 | 53 | 0.69 |
| 6 | 0.75 | 5 | 3 | 6 | 3 | 6.7 | 89 | 65 | 0.73 |
| 7 | 0.50 | 5 | 3 | 8 | 3 | 6.7 | 77 | 54 | 0.70 |
| 8 | 0.50 | 7 | 3 | 6 | 3 | 6.7 | 80 | 58 | 0.73 |
| 9 | 0.50 | 1 | 5 | 6 | 5 | 6.4 | 74 | 58 | 0.79 |
| 10 | 0.50 | 3 | 5 | 6 | 5 | 6.7 | 76 | 61 | 0.81 |
| 11 | 0.50 | 6 | 5 | 6 | 5 | 6.7 | 77 | 65 | 0.84 |
| 12 | — | — | — | — | — | 6.7 | 77 | 39 | 0.51 |

As shown in Table 2, in the drive waveform condition No. 12, the supply/ejection ratio was as low as 0.51, whereas in the drive waveform conditions Nos. 4–11, the supply/ejection ratios were considerably higher than 0.51. Particularly, the supply/ejection ratio obtained in the drive waveform condition No. 1 was as high as 0.84. As can be seen from these examples, it is possible to increase the supply/ejection ratio by appropriately adjusting the time periods q, r, s and t.

FIGS. 7A–7B and 8A–8B indicate changes in the displacement of a piezoelectric element 10 over time when the ink ejection cycle is continually repeated in the embodiments indicated in FIGS. 3 and 4, respectively. In FIGS. 7A–7B and 8A–8B, FIGS. 7A and 8A indicate an example of the capacity changing pattern for a print resolution of 300 dpi, and FIGS. 7B and 8B indicate an example of the capacity changing pattern for a print resolution of 600 dpi.

While the preferred embodiments of the invention have been described, it should be apparent that the change patterns of the displacement of a piezoelectric element 10 indicated in FIGS. 3 and 4 (i.e., the waveforms of the drive voltage), and the various conditions shown in Tables 1 and 3, are merely examples. If the embodiments are modified, for example, if the design of the ink channels in the ink jet head 1 or the viscosity of ink used, is changed, then the preferred forms of the drive voltage waveforms or the various conditions shown in Tables 1 and 2 may well be changed.

The ink ejection control function in a relatively later part of the ejection stage according to the invention need not be continuously in operation, but may be performed selectively only when the ink ejection cycle is continually repeated.

Although, in the foregoing embodiments, the supplying stage precedes the ejecting stage in each ink ejection cycle, the sequence of the supplying stage and the ejecting stage in an ink ejection cycle is not limited to that sequence. For example, if suitable conditions are provided, the sequence may be reversed, thereby achieving substantially the same advantages, as described above.

As understood from the above description, in the ink jet recording apparatus according to the invention, the drive voltage control unit for controlling the drive voltage applied to the piezoelectric elements from the drive voltage generator unit controls the drive voltage so that, in a relatively later part of the ejecting stage in each ink ejection cycle of each ink reservoir chamber, the capacity of the ink reservoir chamber is maintained at a third value between a first value that is achieved in the supplying stage, and a second value that is achieved in the ejecting stage, and then reduced to the second value. Therefore, the ink jet recording apparatus is able to supply a sufficient amount of ink into each ink reservoir chamber, as can be seen from the results of analysis described above. Consequently, it becomes possible to maintain a good balance between the amount of ink supplied into each ink reservoir chamber and the amount of ink ejected therefrom, in each ink ejection.

Furthermore, according to the invention, the drive voltage control unit performs a control function such that, in a relatively later part of the ejecting stage of each ink reservoir chamber, after the capacity of the ink reservoir chamber is maintained at the third value during the course of the capacity reduction of the ink reservoir chamber to the second value, the capacity reduction of the ink reservoir chamber is reduced to the second value. That is, the action of reducing the capacity of the ink reservoir chamber is temporarily paused in an intermediate period of the ink ejecting stage. The temporary pause of the capacity reduction effectively mitigates disturbance in the fluid (ink) caused by the rapid capacity reduction, so that the supplying of ink in the supplying stage of the next ink ejection cycle can be quickly and reliably performed. Furthermore, a supplemental amount of ink can be supplied during an intermediate period of the ejecting stage in the same cycle. Therefore, the ink jet recording apparatus eliminates the situation where there is an insufficient refill during printing and ensures accurate printing at predetermined dot intervals, even if there is a need to continually eject ink from the same nozzle of the ink jet head.

Further, according to the invention, the drive voltage control unit also performs a control function such that, in a later part of the ejecting stage in each ink reservoir chamber, after the capacity of the ink reservoir chamber is reduced to the second value, the capacity is increased to the third value so that ink will not be ejected from the nozzle in a period that follows. The capacity is then reduced again to the second value. That is, immediately after the ink ejection in the ejecting stage, the capacity of the ink reservoir chamber is changed such that it is temporarily increased and then decreased. The capacity changing pattern following the ink ejection effectively mitigates disturbance in the fluid (ink) caused by the rapid capacity reduction in the ejecting stage and, further, adds to the occasion wherein ink is actively drawn into the ink reservoir chamber within one ink ejection cycle. Therefore, the supplying of ink in the supplying stage of the next ink ejection cycle can be quickly and reliably performed In the ink ejection control method according to the invention, the drive voltage applied to the ink reservoir chambers from the drive voltage generator unit is controlled so that, in a relatively later part of the ejecting stage in each ink ejection cycle of each ink reservoir chamber, the capacity of the ink reservoir chamber is maintained at a third value between a first value, that is achieved in the supplying stage, and a second value, that is achieved in the ejecting stage, and then reduced to the second value. Therefore, as in the inkjet recording apparatus, the ink ejection control method is able to supply a sufficient amount of ink into each ink reservoir chamber, as can be seen from the results of analysis described above. Consequently, it becomes possible to maintain a good balance between the amount of ink supplied into each ink reservoir chamber and the amount of ink ejected therefrom in each ink ejection cycle, thereby substantially eliminating the inconvenience where ink is not properly ejected from a nozzle in the ejecting stage.

Furthermore, in the ink ejection control method according to the invention, the drive voltage applied to each ink reservoir chamber from the drive voltage generator unit is controlled so that, in a relatively later part of the ejecting stage, after the capacity of the ink reservoir chamber is maintained at the third value, the capacity of the ink reservoir chamber is reduced to the second value. That is, the action of reducing the capacity of the ink reservoir chamber is temporarily stopped in an intermediate period of the ink ejecting stage, as described in conjunction with the ink reservoir chamber. The temporary stop of the capacity reduction effectively mitigates disturbance in the fluid (ink) caused by the rapid capacity reduction, so that the supplying of ink in the supplying stage of the next ink ejection cycle can be quickly and reliably performed. Furthermore, a supplemental amount of ink can be supplied during an intermediate period of the ejecting stage in the same cycle. Therefore, the ink ejection control method eliminates the situation where there is an insufficient refill during printing and ensures accurate printing at predetermined dot intervals even if there is a need to continually eject ink from the same nozzle of the ink jet head.

Further, in the ink ejection control method according to the invention, the drive voltage applied to each ink reservoir chamber from the drive voltage generator unit is controlled so that, in a later part of the ejecting stage in each ink reservoir chamber, after the capacity of the ink reservoir chamber is reduced to the second value, the capacity is increased to the third value so that ink will not be ejected from the nozzle in a period that follows, and then reduced again to the second value. That is, immediately after ink ejection in the ejecting stage, the capacity of the ink reservoir chamber is changed, that is, temporarily increased and then reduced, as described in conjunction with the ink jet recording apparatus. The capacity changing pattern following the ink ejection, effectively mitigates disturbance in the fluid (ink) caused by the rapid capacity reduction in the ejecting stage and, further, adds to the occasion wherein ink is actively drawn into the ink reservoir chamber within one ink ejection cycle. Therefore, the supplying of ink in the supplying stage of the next ink ejection cycle can be quickly and reliably performed It is to be understood that the invention is not restricted to the particular forms shown in the foregoing embodiments. Various modifications and alterations can be made thereto without departing from the spirit of the invention.

What is claimed is:

1. An ink jet recording apparatus comprising:

an ink jet head including at least one ink reservoir chamber having a predetermined capacity for receiving ink from an ink source and having a nozzle for ejecting ink, and a deformable element associated with the ink reservoir chamber and being deformable by changing a drive voltage thereto so as to change the capacity of the ink reservoir chamber;

a drive voltage generator unit that generates the drive voltage to be applied to the deformable element; and a drive voltage control unit that controls the drive voltage applied to the deformable element from the drive voltage generator unit, wherein an ink ejection cycle that includes a supplying stage in which ink is supplied into the ink reservoir chamber from the ink source by increasing the capacity of the ink reservoir chamber to a first value, and an ejecting stage in which ink is ejected from the ink reservoir chamber through the nozzle by reducing the capacity of the ink reservoir chamber to a second value, wherein the drive voltage control unit controls the drive voltage applied to the deformable element from the drive voltage generator unit so that during the ejecting stage of each ink ejection cycle, the capacity of the ink reservoir chamber is maintained at a third value between the first value and the second value, and then reduced to the second value, the capacity of the ink reservoir chamber being maintained at the third value for a sufficient duration to enable a supplemental amount of ink to be supplied into the ink reservoir chamber from the ink source.

2. The ink jet recording apparatus according to claim 1, wherein the deformable element is a piezoelectric element.

3. The ink jet recording apparatus according to claim 2, wherein the capacity of the ink reservoir chamber is maintained at a third value between the first value and the second value, and then reduced to the second value, in a relatively later part of the ejecting stage.

4. The ink jet recording apparatus according to claim 2, wherein the drive voltage control unit controls the drive voltage applied to the piezoelectric element from the drive voltage generator unit so that, during the ejecting stage, after the capacity of the ink reservoir chamber is maintained at the third value during the course of capacity reduction of the ink reservoir chamber to the second value, the capacity of the ink reservoir chamber is reduced to the second value.

5. The ink jet recording apparatus according to claim 2, wherein the drive voltage control unit controls the drive voltage applied to the piezoelectric element from the drive voltage generator unit so that, during the ejecting stage, after the capacity of the ink reservoir chamber is reduced to the second value, the capacity of the ink reservoir chamber is increased to the third value so that ink will not be ejected from the nozzle in a period that follows, and then reduced again to the second value.

6. An ink ejection control method in an ink jet recording apparatus including an ink jet head which has at least one ink reservoir chamber having a predetermined capacity for receiving ink from an ink source and having a nozzle for ejecting ink, and which further has a deformable element associated with the ink reservoir chamber and being deformable by changing a drive voltage thereto so as to change the capacity of the ink reservoir chamber, the ink jet recording apparatus further including a drive voltage generator unit that generates the drive voltage to be applied to the deformable element, the ink ejection control method comprising the steps of:

controlling the drive voltage applied to the deformable element from the drive voltage generator unit, so as to achieve an ink ejection cycle that includes a supplying stage in which ink is supplied into the ink reservoir chamber from the ink source by increasing the capacity of the ink reservoir chamber to a first value, and an ejecting stage in which ink is ejected from the ink reservoir chamber through the nozzle by reducing the capacity of the ink reservoir chamber to a second value; and controlling the drive voltage applied to the deformable element from the drive voltage generator unit so that, during the ejecting stage of each ink ejection cycle, the capacity of the ink reservoir chamber is maintained at a third value between the first value and the second value, and then reduced to the second value, the capacity of the ink reservoir chamber being maintained at the third value for a sufficient duration to enable a supplemental amount of ink to be supplied into the ink reservoir chamber from the ink source.

7. The ink ejection control method according to claim 6, wherein the deformable element is a piezoelectric element.

8. The ink jet control method according to claim 7, wherein the capacity of the ink reservoir chamber is maintained at a third value between the first value and the second value, and then reduced to the second value, in a relatively later part of the ejecting stage.

9. The ink ejection control method according to claim 7, wherein the drive voltage applied to the piezoelectric element from the drive voltage generator unit is controlled so that, during the ejecting stage, after the capacity of the ink reservoir chamber is maintained at the third value during the course of capacity reduction of the ink reservoir chamber to the second value, the capacity of the ink reservoir chamber is reduced to the second value.

10. The ink ejection control method according to claim 7, wherein the drive voltage applied to the piezoelectric element from the drive voltage generator unit is controlled so that, during the ejecting stage, after the capacity of the ink reservoir chamber is reduced to the second value, the capacity of the ink reservoir chamber is increased to the third value so that ink will not be ejected from the nozzle in a period that follows, and then reduced again to the second value.

11. An ink jet recording apparatus comprising:

an ink jet head including at least one ink reservoir chamber having a predetermined capacity for receiving ink from an ink source and having a nozzle for ejecting ink, and a deformable element associated with the ink reservoir chamber and being deformable by changing a drive voltage thereto so as to change the capacity of the ink reservoir chamber;

drive voltage generator means for generating the drive voltage to be applied to the deformable element; and drive voltage control means for controlling the drive voltage applied to the deformable element from the drive voltage generator means, so as to achieve an ink ejection cycle that includes a supplying stage in which ink is supplied into the ink reservoir chamber from the ink source by increasing the capacity of the ink reservoir chamber to a first value, and an ejecting stage in which ink is ejected from the ink reservoir chamber through the nozzle by reducing the capacity of the ink reservoir chamber to a second value;

wherein the drive voltage control means for controlling the drive voltage applied to the deformable element from the drive voltage generator unit so that, during the ejecting stage of each ink ejection cycle, the capacity of the ink reservoir chamber is maintained at a third value between the first value and the second value, and then reduced to the second value, the capacity of the ink reservoir chamber being maintained at the third value for a sufficient duration to enable a supplemental amount of ink to be supplied into the ink reservoir chamber from the ink source.

12. The ink jet recording apparatus according to claim 11, wherein the deformable element is a piezoelectric element.

13. The ink jet recording apparatus according to claim 12, wherein the capacity of the ink reservoir chamber is maintained at a third value between the first value and the second value, and then reduced to the second value, in a relatively later part of the ejecting stage.

14. The ink jet recording apparatus according to claim 12, wherein the drive voltage applied to the piezoelectric element from the drive voltage generator means it is controlled so that, during the ejecting stage, after the capacity of the ink reservoir chamber is maintained at the third value during the course of capacity reduction of the ink reservoir chamber to the second value, the capacity of the ink reservoir chamber is reduced to the second value.

15. The ink jet recording apparatus according to claim 12, wherein the drive voltage applied to the piezoelectric element from the drive voltage generator means is controlled so that, during the ejecting stage, after the capacity of the ink reservoir chamber is reduced to the second value, the capacity of the ink reservoir chamber is increased to the third value so that ink will not be ejected from the nozzle in a period that follows, and then reduced again to the second value.

* * * * *